United States Patent [19]

Izumitani et al.

[11] 4,277,523

[45] Jul. 7, 1981

[54] METHOD OF PREVENTING TARNISHING OF POLISHED GLASS ARTICLES

[75] Inventors: Tetsuro Izumitani, Hino; Eimei Miyade, Niiza, both of Japan

[73] Assignee: Hoya Glass Works, Ltd., Tokyo, Japan

[21] Appl. No.: 758,272

[22] Filed: Jan. 10, 1977

Related U.S. Application Data

[63] Continuation of Ser. No. 497,346, Aug. 13, 1974, abandoned.

[30] Foreign Application Priority Data

Aug. 13, 1973 [JP] Japan ..... 48-90721

[51] Int. Cl.[3] ..... B05D 3/00; B01J 19/00

[52] U.S. Cl. ..... 427/294; 422/40; 427/165

[58] Field of Search ..... 21/2; 427/294, 165; 422/40

[56] References Cited

U.S. PATENT DOCUMENTS

| | | | |
|---|---|---|---|
| 1,994,483 | 3/1935 | Ott | 427/165 X |
| 2,398,382 | 4/1946 | Lyon | 427/294 |
| 2,456,899 | 12/1948 | Strong | 427/294 |
| 2,532,971 | 12/1950 | Van Leer et al. | 427/294 |
| 2,808,351 | 10/1957 | Colbert et al. | 427/294 |
| 3,212,918 | 10/1965 | Tsu et al. | 427/294 |
| 3,898,351 | 8/1975 | Kennison et al. | 427/294 X |

*Primary Examiner*—Barry Richman

*Attorney, Agent, or Firm*—Sughrue, Rothwell, Mion, Zinn and Macpeak

[57] ABSTRACT

A method of preventing tarnishing of a polished glass article comprising storing the polished glass article under a reduced pressure of less than $10^{-2}$ mm Hg before applying a metal, a metal oxide or fluoride coating to the surface of the polished glass.

8 Claims, 1 Drawing Figure

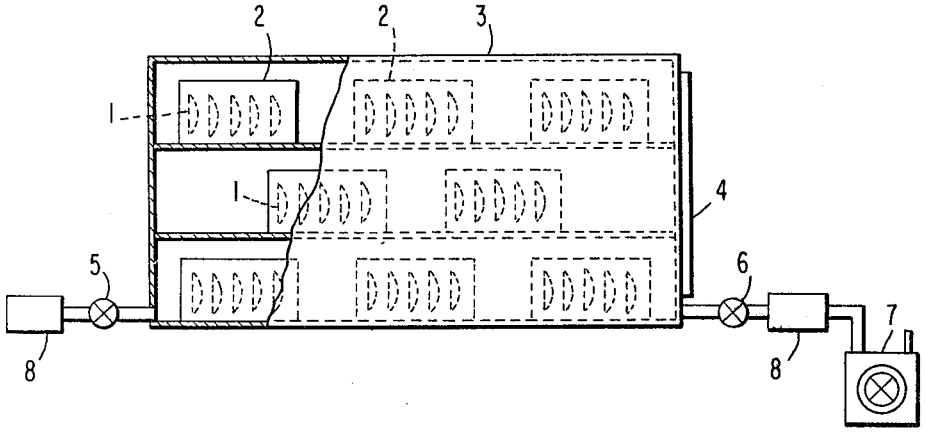
2
2
3
1
1
4
5
6
7
8
8

METHOD OF PREVENTING TARNISHING OF POLISHED GLASS ARTICLES

This is a continuation of application Ser. No. 497,346, filed Aug. 13, 1974, now abandoned.

BACKGROUND OF THE INVENTION

1. Field of the Invention

This invention relates to a method of preventing tarnishing of a polished glass article during storage.

2. Description of the Prior Art

Recently, most glass articles have been used after applying various types of metal, metal oxide or fluoride coatings to the polished surface of the glass articles. However, tarnishing of the polished surface of the glass article often occurs during storage before applying the coating, and the cause of the tarnishing is a most serious problem to be solved.

If the coating is applied on even a slightly corroded surface of the glass article, the defect shows up clearly due to the interference phenomenon, and, in a typical case, the coating peels off. Tarnishing to an extent which influences the coating of the glass occurs in an unexpectedly short period of time on some types of glass. For example, tarnishing occurs in atmospheric air only several minutes after the polishing, washing and drying treatments, for some types of glass, and, in some cases, the application of the coating becomes impossible.

Accordingly, polished glass can not be stored for a long period of time before the coating is applied, and the flexibility in production of coated glass articles is therefore greatly restricted.

SUMMARY OF THE INVENTION

An object of this invention is to provide a process for preventing detrimental tarnishing on the surface of the glass, which is polished, washed and dried, before a coating is applied.

The dimming and staining of a polished glass occur when the moisture in the air adheres to the glass surface and reacts with the glass to form a thin film or fine powder.

It has now been discovered that if a polished glass is preferably stored in a reduced pressure, corrosion by moisture of the polished glass surface can be prevented.

The adhesion of moisture or moisture condensation on the glass surface is usually prevented by adjusting the storing temperature to be consistent with room temperature ±5° C. or keeping the moisture level below 50% humidity thereby to suppress the formation of tarnishing. This method is effective for preventing tarnishing in a cold or dry winter season, but is not fully effective in a rainy season.

This invention was made on a discovery that tarnishing is formed by not only moisture condensation on the glass surface but also by the moisture in the atmosphere and the total amount of the moisture influences tarnish formation. Accordingly, a feature of this invention is to store the glass article, which is polished, washed and dried, in a reduced pressure of less than $10^{-2}$ mm Hg before applying the coating thereby to prevent completely the formation of tarnishing. The control of the storage temperature is additionally effective to prevent tarnishing. Suitably the polished glass article can be stored at a temperature of about −10° C. to +50° C.

If desired, the storing can be carried out in a dry nitrogen gas atmosphere under reduced pressure. The evacuating pump is preferably equipped with a device for stopping the back flow of oil.

BRIEF DESCRIPTION OF THE DRAWING

The FIGURE shows a partially cross sectioned elevation of an apparatus for storing the polished glass.

DESCRIPTION OF PREFERRED EMBODIMENTS OF THE INVENTION

A glass composed of $SiO_2$(25 to 35 wt.%), $B_2O_3$(15 to 25 wt.%), BaO(45 to 55 wt.%) and $Al_2O_3$(0.5 to 3.5 wt.%), which most easily tarnishes, was polished, washed and dried, and then stored in a reduced pressure apparatus as shown in the FIGURE. Referring to the FIGURE, a polished glass article 1 is charged in a gas permeable vessel 2, and a plurality of vessels are stored in a container 3.

After applying a cover 4, the container 3 is evacuated by closing a lee cock 5, opening a cock 6 and actuating a vacuum pump 7.

When the pressure in the container 3 is reduced to below $10^{-2}$ mm Hg, the cock 6 is closed and the inner pressure is kept at a level below $10^{-2}$ mm Hg. Numeral 8 indicates an air filter. This container is able to maintain the inner pressure at a level below $10^{-2}$ mm Hg for more than 73 hours in one vacuum reduction operation.

The glass articles exposed to usual atmospheric air exhibited surface tarnishing in only 30 minutes, but no surface tarnishing was observed even upon inspection with a microscope after storage for about 73 hours under a reduced pressure of below $10^{-2}$ mm Hg in the container.

As described above, the process of this invention is capable of preventing the formation of tarnishing of a polished and dried glass article for a considerably long period of time as long as a reduced pressure level is maintained. Accordingly, the process of this invention is effective basically for all types and compositions of glass and particularly for the conventional SK type optical glass which exhibits tarnishing, and the yield of glass articles is not reduced when humidity conditions are high irrespective of the types of the glass.

In addition, the process of this invention is effective to prevent tarnish formation in applying a coating not only to ordinary glass articles but also to optical glasses and glass lenses.

While this invention has been described with reference to particular embodiments thereof, it will be understood that numerous modifications can be made by those skilled in the art without actually departing from the scope of the invention.

Therefore, the appended claims are intended to cover all such equivalent variations as coming within the true spirit and scope of the invention.

What is claimed is:

1. A method of preventing tarnishing of a polished glass article by corrosion of the polished glass surface due to moisture, which method comprises storing the polished glass article under a pressure of less than about $10^{-2}$ mm Hg Absolute and maintaining said pressure level until said polished glass surface is to be further processed in a tarnish-free condition.

2. The method of claim 1, wherein said storage prevents contact of said polished glass article with moisture, whereby said tarnishing is prevented.

3. The method of claim 1, wherein said glass article is polished, washed and dried prior to said storage.

4. The method of claim 1, wherein said storage is effected after polishing said glass article but before tarnish can be formed on the surface thereof and is terminated at a period of time prior to coating said glass article which is insufficient for tarnish to form thereon.

5. The method of claim 1, wherein said storage is at a temperature of about $-10°$ C. to $+50°$ C.

6. The method of claim 1, wherein said storage is for about 73 hours.

7. The method of claim 1, wherein said storage is in dry nitrogen gas under said reduced pressure.

8. A method of producing a glass article of improved quality comprising polishing a glass article, substantially immmdiately storing the polished glass article under a reduced pressure of less than about $10^{-2}$ mm Hg Absolute and applying a metal, a metal oxide or a fluoride coating onto the surface of the glass article substantially immediately after removal of said glass article from said reduced pressure, said storing being during the period after polishing said glass article and until said applying step.

* * * * *